United States Patent [19]

Hutter

[11] Patent Number: 4,684,159

[45] Date of Patent: Aug. 4, 1987

[54] SAFETY LATCH FOR DOORS AND SIMILAR STRUCTURES

[76] Inventor: Romuald J. Hutter, 561 Weymouth Ct., Anaheim, Calif. 92807

[21] Appl. No.: 762,219

[22] Filed: Aug. 5, 1985

[51] Int. Cl.[4] ..... E05B 17/16

[52] U.S. Cl. ..... 292/268

[58] Field of Search ..... 292/250, 268, 269, 270; 24/67.5

[56] References Cited

U.S. PATENT DOCUMENTS

| | | | |
|---|---|---|---|
| 189,823 | 4/1877 | Whipple | 292/269 |
| 372,326 | 11/1887 | Palmenberg | 292/268 |
| 540,019 | 5/1895 | Gay | 292/269 |
| 937,094 | 10/1909 | Rosenberg | 292/268 |
| 1,596,183 | 8/1926 | Horlick, Jr. | 292/268 X |
| 2,442,733 | 6/1948 | Schultz | 292/268 |
| 3,286,381 | 11/1966 | Wooge | 24/67.5 |
| 4,326,739 | 4/1982 | Schlueter | 292/247 |

*Primary Examiner*—Richard E. Moore

*Attorney, Agent, or Firm*—Thomas J. Plante

[57] ABSTRACT

A safety latch construction is disclosed, of the type which has a rigid, pivoted slot-providing member secured to the doorframe, and a runner secured to the door having a T-shaped projection which engages the slot when the safety latch is operative, thereby limiting the amount of door opening movement. All of the parts are formed by stamping processes. No casting or machining is required. The doorframe member includes (a) a supporting member secured to the doorframe and having integral flanges providing pivot apertures, and (b) a pivoted member having an elongated slot formed between metal side bars which have projecting pivot pins and which are spaced at their pivoted ends, the resiliency of the side bars permitting the pivoted member to be readily assembled to the supporting member. An additional locking member provides a deadbolt feature.

9 Claims, 17 Drawing Figures

SAFETY LATCH FOR DOORS AND SIMILAR STRUCTURES

BACKGROUND OF THE INVENTION

This invention relates to an improved safety latch construction for use with doors, windows, or any other structure which needs to have the safety feature that permits partial opening without losing the protection of the latch.

The commercially common form of such safety latches is the chain-and-slot construction customarily used on hotel room doors. Because of the deficiencies of those latches, the patent art discloses numerous structures, many of them during the 19th Century, intended to substitute a rigid, pivoted latch member for the chain structure. As pointed out in one of those prior art patents, U.S. Pat. No. 4,408,789, the safety "chains provided are usually not sufficiently strong to withstand a heavy impact on the door and, therefore, do not provide the desired safety from forced entry by intruders." That patent also lists a number of prior art efforts to solve the safety latch problem. Additional deficiencies of chain latches are discussed in U.S. Pat. No. 3,458,226 which refers to (a) their susceptibility to unlatching if slightly ajar, (b) their unsightly appearance, and (c) their inconvenience.

The long-standing existence of this problem is further emphasized by several very old prior art patents which were discovered by the present applicant in searching this field of art, including the following U.S. Pat. Nos. 189,822, issued in 1877; 251,732, issued in 1882; 465,185 issued in 1891; 473,785, issued in 1892; and 534,716, issued in 1895.

Because there has been an exhaustive search for a solution to this problem, the continued use of the unsatisfactory chain latches indicates a need for the present invention.

SUMMARY OF THE INVENTION

A major accomplishment of the present invention is the creation of a rigid, pivoted latch sub-assembly which can be manufactured at a lower cost than even the inexpensive chain latches, while providing both the greatly improved safety of a rigid latch and the aethestic benefits of a visually attractive structure.

The cost reduction results from the elimination of all casting and machining operations, and from minimizing the number of parts, all of which are formed by stamping (press working)processes.

The pivoted, slotted arm of the latch and its supporting structure are provided by (a) a support attached to the door-containing structure, (b) a slot-providing member having spaced sides open at one end and sufficiently resilient to be sprung into pivotal engagement with the support, and (c) a retaining plate which prevents subsequent disengagement of the slot-providing member from the support.

DETAILED DESCRIPTION OF PREFERRED EMBODIMENT

Figure 2A:
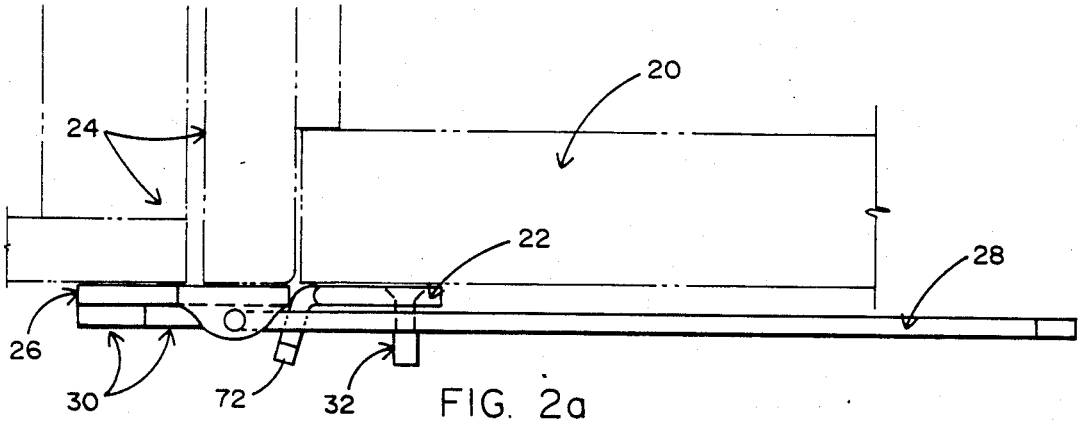
FIGS. 2*a* and 3 are top (or bottom) and end views, respectively, of the structure of FIG. 1.
Figure 1:
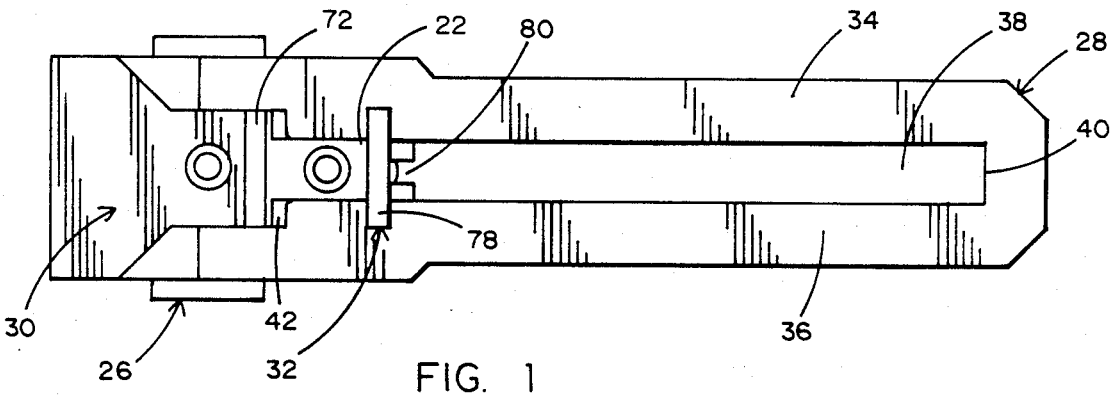
FIG. 1 is a front elevation of the fully assembled safety latch in its locked position.
Figure 3:
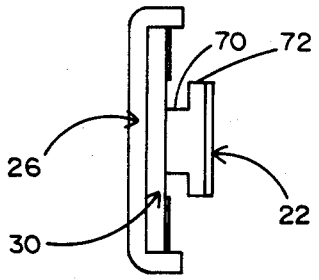

FIGS. 1–3 show the assembled latch construction of the present invention, with the door (or other hinged member) in its closed and fully-protected position. A door, shown generally at 20, has secured thereto a plate 22, which provides the "runner" portion of the latch, i.e., the portion which travels inside a slot in a pivoted member secured to the door frame, thus permitting some opening movement of the door, but limiting that movement to the length of the slot. A door frame, shown generally at 24, and including the 2″×4″ structure surrounding the frame, carries a sub-assembly comprising a plate 26 secured to the frame; a pivoted, slotted hasp, or fork-like member, 28, which provides the "slotted" portion of the latch; and a plate 30 which retains the hasp 28 and plate 26 in assembled position. An additional lock member 32 may be provided to permit using the structure as a deadbolt, if desired. The most likely use of the present invention is with doors; but it would also be useful with windows, or any other structures which are arranged to have one edge swing between closed and open positions.

The structure, and its particular benefits, can be readily understood by viewing the parts separately. As previously stated, each part is stamped (press-formed), i.e., it requires only those processes included in the McGraw-Hill definition of "stamping" as: "Stamping -almost any press operation, including blanking, shearing, hot or cold forming, drawing, bending, and coining." Thus, the present invention avoids the need for any casting or machining processes; and it does not require any typical hinges for the pivoted member 28. This manufacturing advantage reduces costs, and also permits a very high-strength latch, preferably using carbon steel, such as AISI #1040. Another benefit is the attractiveness of the finished product, including the essentially flush mounting position it permits in either its engaged or disengaged positions. The steel parts may be brassplated for aesthetic purposes.

Figure 4:
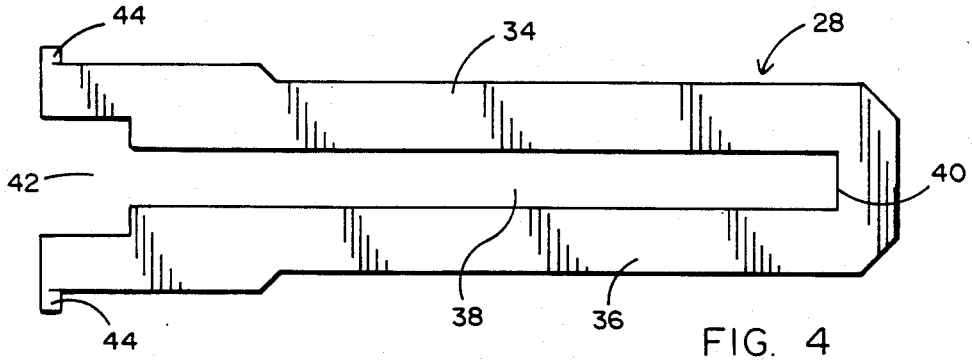
FIGS. 4 and 5 are front and side views, respectively, of the forked, or slotproviding, member in the latch of FIGS. 1–3.
Figure 5:
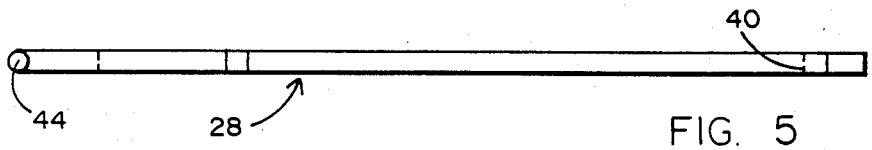

FIGS. 4 and 5 show the slot-providing member, or fork-shaped hasp, 28 which will be pivotally mounted on the frame. It is an easily formed flat metal part having two longitudinally-extending side bars 34 and 36, between which a slot 38 is provided. The closed end 40 of slot 38 is the movement-limiting surface of the hasp, i.e., it prevents further opening of the door when it is engaged by the runner mounted on the door.

The left ends (as seen in the figures) of the side bars 34 and 36 are not joined, leaving an open space 42. At the left end of each side bar, an outwardly-projecting, integral, rounded pivot pin 44 is formed. The metal side bars 34 and 36 have sufficient resilience to permit manual pressure to move their spaced ends temporarily closer together. This permits the integral pivot pins 44 to be snapped into position in complementary apertures in the support member, i.e., plate 26.

The open space 42 at the open end of forked hasp 28 is wider than the slot, or channel, 38, in order to permit entry of the head of the door-mounted runner.

Figure 6:
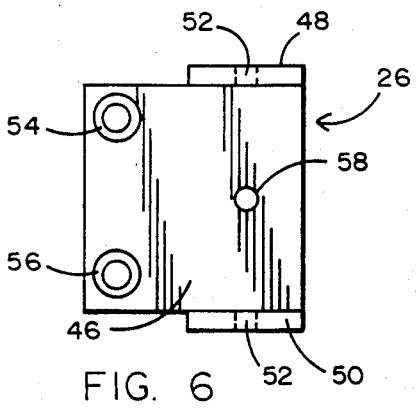
FIGS. 6, 7 and 8 are front, top (or bottom) and end views, respectively, of the support member in the latch of FIGS. 1–3, which member is secured to the door frame, or jamb, and on which the slot-providing member is pivotally mounted.
Figure 8:
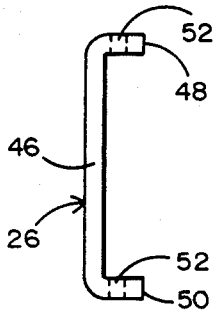
Figure 7:
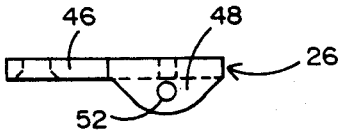

FIGS. 6–8 show the support member 26, on which slot-providing member 28 is pivotally mounted. Support member 26 is an easily formed metal part having a flat plate portion 46 and two integral projecting portions, or flanges, 48 and 50 perpendicular to plate portion 46. The flanges each have a round opening 52 adapted to receive one of the pivot pin projections 44 on the side bars of the slotted member 28. The pivot pin 44 on upper side bar 34 fits into opening 52 in the upper flange 48; and the pivot pin 44 on lower side bar 36 fits into opening 52 in the lower flange 50.

The plate portion 46 is secured rigidly to the door frame. For this purpose, a plurality of fastener openings are provided. The primary holding force is provided by large screws which enter openings 54 and 56, and extend into the 2"×4" which is part of the rough framing around the door frame. Another opening 58 is provided for a smaller screw entering into the door frame. For improved appearance, all visible screw heads are countersunk.

After support plate 26 has been secured to the rough frame with relatively large fasteners extending through openings 54 and 56, the fork-shaped hasp 28 is mounted in its pivoted position by applying sufficient manual force to move the open ends of side bars 34 and 36 toward one another until they permit pivot pins 44 to slide between flanges 48 and 50 of support plate 26. When the pins 44 are in line with the openings 52, the inherent resilience of the side bars forces the pivot pins into the openings, thus providing an easy assembled, but secure, pivoted support for member 28.

Figure 9:
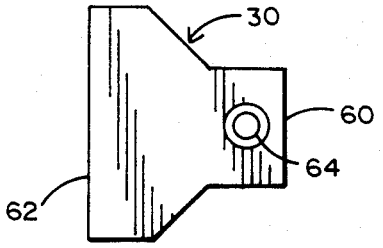
FIGS. 9 and 10 are front and end views, respectively, of the retaining plate in the latch of FIGS. 1–3.
Figure 10:
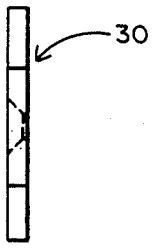

FIGS. 9 and 10 show the flat retaining plate 30 which is placed on top of support plate 26. It has a reduced width portion 60 which fits between the spaced inner ends of side bars 34 and 36, thereby locking the pivot pins 44 in position, because they cannot be removed from the openings 52 until retaining plate 30 has been removed. The enlarged left portion 62 of retaining plate 30 is designed to cover the fasteners in support plate 26, for aesthetic reasons; and retaining plate 30 may be secured in place by a single fastening member extending into doorframe 24 through both an opening 64 in plate 30 and the opening 58 in plate 22.

The three piece structure, comprising plates 26 and 30 and pivoted slotted member 28, constitutes a very useful frame-mounted sub-assembly. It provides strength, manufacturing simplicity (including cost reduction), and attractive appearance. By eliminating the chain-and-slot construction, it provides greatly increased safety, and much easier use for the occupant of the room.

Figure 11:
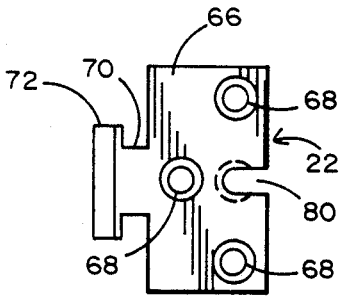
FIGS. 11, 12 and 13 are front, top (or bottom), and end views, respectively, of the runner, or door-mounted bracket, in the latch of FIGS. 1–3.
Figure 13:
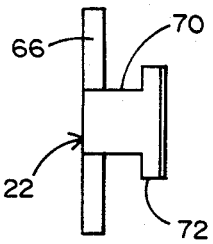
Figure 12:
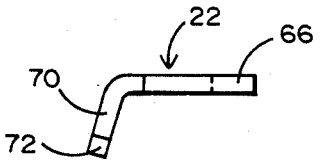

FIGS. 11–13 show the "runner," or slot-engaging member 22, which is secured to the door, and which provides a movement-limiting connection to privoted member 28 whenever the latter is swung toward the closed door. Member 22 also is formed by stamping. It has a flat portion 66 lying against, and secured to, a solid portion of the door by means of fastening members extending through a plurality of openings 68 (three are shown). The left portion of runner 22 (FIGS. 11 and 12) is bent upwardly from flat portion 66 to form a slot-engaging flange, which may have an essentially T-shaped form. The stem portion 70 of the runner flange is narrow enough to slide in slot 38 of the hasp 28, whereas the widened head portion 72 of the runner flange is wider than the slot, except at the enlarged opening 42.

When the door is closed and the hasp 28 lies against the door (FIGS. 1 and 2*a*), the head portion 72 of runner 22 extends through the enlarged slot 42 in the left, or pivoted, end of the hasp. If the door is then moved toward opened position, the runner flange 70–72 will slide along slot 38 of the hasp, the runner and hasp being prevented from disconnection by the engagement of the widened head portion 72 with the hasp. When the runner stem portion 70 engages the closed end 40 of slot 38, no further door opening movement is possible.

At that point, in order to open the door wider, it would be necessary to close the door, swing the hasp 28 on its pivot from its door-engaging position toward its doorframe-engaging position (180° movement is possible). When such pivoted movement of hasp 28 brings slot 38 past runner head 72, the door can be opened as widely as desired.

Figure 14:
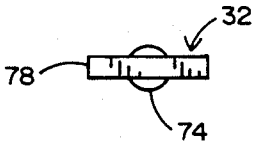
FIGS. 14, 15 and 16 are front, top and end views, respectively, of the rotatable lock member in the latch of FIGS. 1–3.
Figure 15:
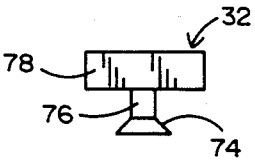
Figure 16:
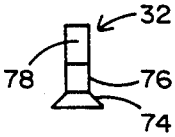

FIGS. 14–16 show an additional feature which may be conveniently added to provide a deadbolt capability, which prevents opening the door from the outside. The lock member 32, which also may be manufactured by stamping processes, has a head 74 which can be held in place under the flat portion 66 of runner plate 22. Head portion 74 is integral with a stem 76 terminating in a locking bar 78. Lock member 32 may be initially assembled by sliding stem 76 into a slot 80 formed in the flat portion 66 of runner plate 22. The runner plate holds head portion 74 of lock member 32 against the door, but does not prevent rotation of lock member 32. In FIGS. 1 and 2*a* the lock bar 78 extends vertically, thus preventing any movement of the door with respect to hasp 28. In other words, a maximum security latch is provided. When lock bar 78 is manually turned to a horizontal position, as in FIG. 2*b*, relative movement of the door and hasp is not inhibited by lock bar 78.

Figure 2B:
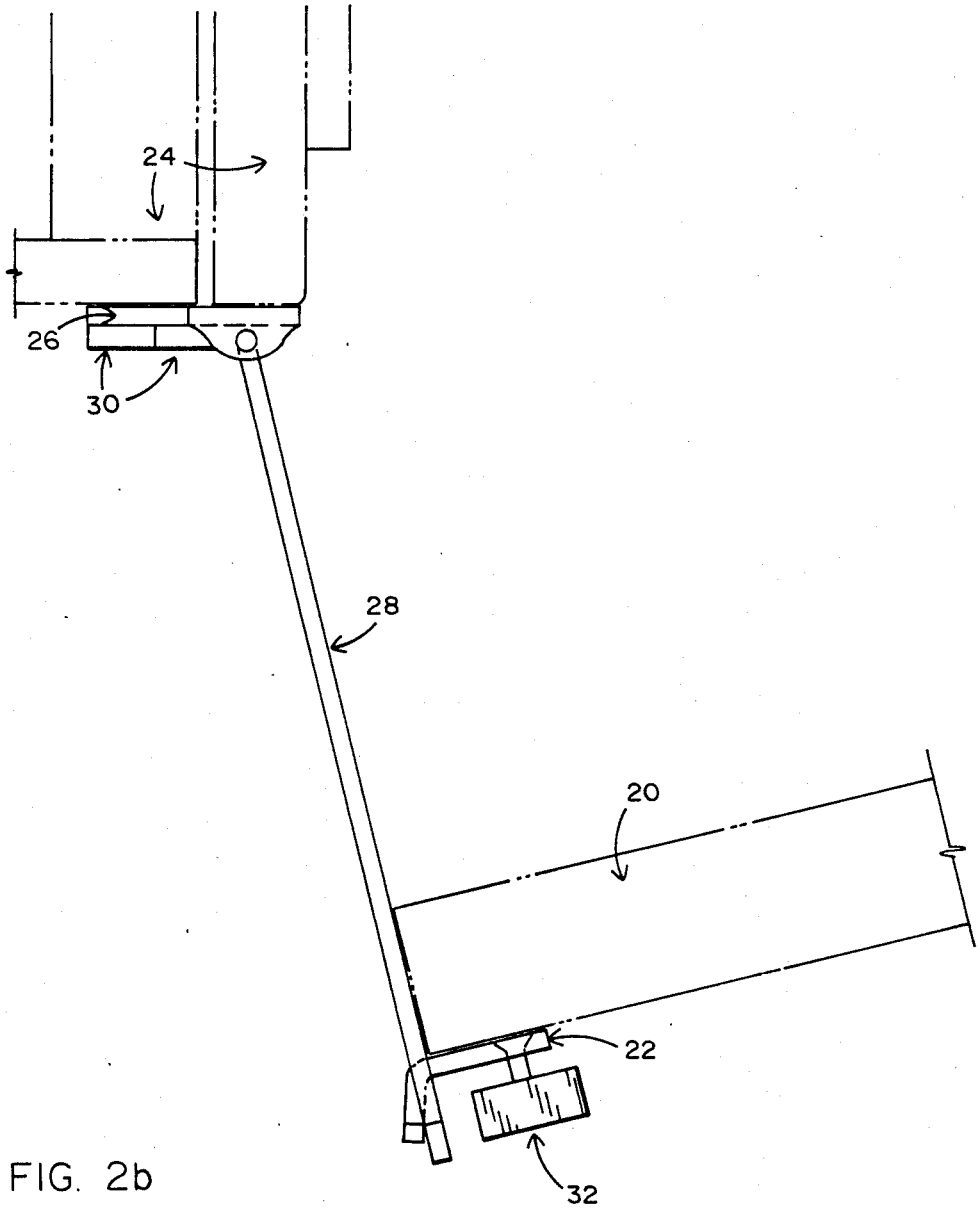
FIG. 2*b* is a top (or bottom) view of the latch structure of FIG. 2*a*, showing the door and latch in the partially open, but latched, position.

FIG. 2*b* shows the door 20 in a partially opened position, with the runner head 72 in position to prevent disengagement of runner 22 from hasp 28. This limits the amount of door opening, permitting the occupant of the room to determine whether or not to allow entrance of a person outside the room. If the occupant wishes to fully open the door, it is necessary first to close the door from its partially opened position. The safety latch will still be operative. In order to render it inoperative, the occupant, after closing the door, can move hasp 28 to the left (clockwise as seen in FIGS. 2*a* and 2*b*) until the opening 42 and hasp 28 passes over the head 72 of runner 22. The hasp can be rotated 180°. bringing it into essentially flush-mounted position against the wall, which is desirable from an appearance standpoint.

From the foregoing description, it is clear that the present invention provides a unique safety latch construction, which for the first time permits low cost replacement of chain latches, and eliminates their performance deficiencies while matching or reducing the cost. The safety latch of the present application combines low manufacturing cost with ease of operation, very high strength, effective protection, and attractive appearance.

The following claims are intended not only to cover the specific embodiments disclosed, but also to cover the inventive concepts explained herein with the maximum breadth and comprehensiveness permitted by the prior art.

What is claimed is:

1. A safety latch for a door or other movable first structure, which is mounted in a second structure forming a frame and which is arranged to open at one side and to pivot at the opposite side, the latch having first structure and second structure mounted elements which are adapted to be interengaged to permit partial opening of the movable structure without latch disconnection, and which comprise:

a first one-piece stamped metal element having (a) a flat portion adapted to be secured against the second structure and (b) two spaced integral flanges which extend substantially at right angles from the flat portion and which constitute pivot-providing flanges;

a second one-piece stamped metal element having two elongated flat side bars which are separated by an elongated slot, and which are connected at one end and open at the other end, the side bars of the second element being pivotally engaged with the pivot-providing flanges of the first element, and the second element having sufficient resilience to (a) permit temporary deflection of the open ends of the side bars to bring them into such pivotal engagement and (b) subsequent springing back to retain them in their pivotally engaged position; and a third metal element having a portion adapted to be secured to the first structure and a runner portion extending at an angle to the first structure, the runner portion having a stem which is movable in the elongated slot of the second element and a head which is wider than the slot in order to prevent disengagement of the second and third elements after they have been moved into interengaging positions.

2. The safety latch of claim 1 in which the third metal element is a one-piece stamped element having a flat portion adapted to be secured to the movable structure and an integral upwardly bent portion constituting the runner portion.

3. The safety latch of claim 1 in which the spaced integral flanges of the first element have openings formed therein to provide pivotal engagement, and the two side bars of the second elements have integral laterally-extending pins which enter the openings in those flanges as a result of the temporary deflection and subsequent springing back of the open ends of the side bars.

4. The safety latch of claim 3 in which the temporary resilient deflection of the open ends of the two side bars reduces the distance between them, in order to permit them to extend between the two flanges of the first element.

5. The safety latch of claim 4 which also comprises:

a fourth element which is secured on top of the first element and which has a portion extending between the side bars of the second element in order to prevent disassembling of the pivotal connection until the fourth element has been removed.

6. The safety latch of claim 5 in which the fourth element is a flat one-piece stamped metal element.

7. The safety latch of claim 1 which also comprises:

a latch locking member which is rotatively supported by the third element, and which has a body portion extending through the slot in the second element when the second and third elements are in their relative interengaging positions;

the locking member having an oblong head portion which is manually rotatable between an unlocked position in which it can pass through the slot and a locked position in which it cannot pass through the slot.

8. A safety latch for a door or other movable first structure, which is mounted in a second structure forming a frame and which is arranged to open at one side and to pivot at the opposite side, the latch having first structure and second structure mounted elements which are adapted to be interengaged to permit partial opening of the movable structure without latch disconnection, and which comprise:

a first element having (a) a flat portion adapted to be secured against one of the first and second structures, and (b) two spaced integral flanges which extend substantially at right angles from the flat portion and which constitute pivotproviding flanges;

a second element having two elongated flat side bars which are separated by an elongated slot, and which are connected at one end and open at the other end, the side bars of the second element being pivotally engaged with the pivot-providing flanges of the first element, and the second element having sufficient resilience to (a) permit temporary deflection of the open ends of the side bars toward one another and (b) cause subsequent expansion to engage and retain them in pivotal connection with the flanges of the first element;

a third element which has (a) a portion adapted to be secured to the other of the first and second structures and (b) a runner portion having a stem which is movable in the elongated slot of the second element and a head which is wider than the slot in order to prevent disengagement of the second and third elements after they have been moved into interengaging positions; and a fourth element which is secured on top of the first element and which extends between the open ends of the side bars of the second element in order to prevent disassembling of the pivotal connection until the fourth element has been removed.

9. The safety latch of claim 8 in which each of the first, second and fourth elements is a one-piece stamped metal element.

* * * * *